US005688471A

United States Patent [19]

Smith et al.

[11] Patent Number: 5,688,471

[45] Date of Patent: Nov. 18, 1997

[54] HIGH STRENGTH LOW THERMAL EXPANSION ALLOY

[75] Inventors: John Scott Smith, Proctorville, Ohio; Ladonna Sheree Hillis, Orlando, Fla.; Melissa Ann Moore, Littleton, Colo.

[73] Assignee: Inco Alloys International, Inc., Huntington, W. Va.

[21] Appl. No.: 696,487

[22] Filed: Aug. 14, 1996

Related U.S. Application Data

[63] Continuation-in-part of Ser. No. 519,678, Aug. 25, 1995, abandoned.

[51] Int. Cl.[6] ..... C22C 38/08; C22C 32/00

[52] U.S. Cl. ..... 420/94; 420/95; 420/97; 420/581; 420/584.1; 420/586

[58] Field of Search ..... 420/94, 95, 97, 420/584.1, 581, 586

[56] References Cited

U.S. PATENT DOCUMENTS

| | | | |
|---|---|---|---|
| 3,514,284 | 5/1970 | Eiselstein . | |
| 3,705,827 | 12/1972 | Muzyka et al. | 148/142 |
| 3,971,677 | 7/1976 | Mason et al. . | |
| 4,445,943 | 5/1984 | Smith, Jr. et al. | 148/12.3 |
| 4,517,158 | 5/1985 | Miyauchi et al. | 420/97 |
| 5,304,346 | 4/1994 | O'Donnell et al. | 420/580 |

FOREIGN PATENT DOCUMENTS

| | | | |
|---|---|---|---|
| 75416 | 3/1983 | European Pat. Off. . | |
| 2139424 | 5/1972 | France . | |
| 1558714 | 4/1970 | Germany . | |
| 57-26144 | 2/1982 | Japan | 420/95 |
| 4-180542 | 6/1992 | Japan . | |
| 7-166298 | 6/1995 | Japan . | |
| 404965 | 7/1966 | Switzerland . | |
| 1411693 | 5/1974 | United Kingdom | 420/95 |

*Primary Examiner*—Deborah Yee

*Attorney, Agent, or Firm*—Blake T. Biederman; Edward A. Steen

[57] ABSTRACT

The alloy of the invention provides a low coefficient of thermal expansion alloy having a CTE of about $4.9\times10^{-6}$ m/m/°C. or less at 204° C. and a relatively high strength. The alloy contains about 40.5 to about 48 nickel, about 2 to about 3.7 niobium, about 0.75 to about 2 titanium, about 0 to about 1 aluminum, about 3.7 or less total niobium plus tantalum and a balance of iron and incidental impurities. Alloys of the invention may be aged to a Rockwell C hardness of at least about 30.

11 Claims, 3 Drawing Sheets

HIGH STRENGTH LOW THERMAL EXPANSION ALLOY

This is a continuation-in-part of U.S. Ser. No. 08/519,678, filed Aug. 25, 1995, now abandoned.

FIELD OF INVENTION

This invention relates to low expansion alloys. In particular, this invention relates to low expansion iron alloys containing about 40.5 to about 48 weight percent nickel.

BACKGROUND OF THE ART AND PROBLEM

The nickel-containing alloy tooling or fixtures used for curing graphite-epoxy composites must have very low thermal expansion coefficients. The low coefficients of thermal expansion are necessary to decrease stresses arising from thermal expansion mismatch that occurs during heating of resin-containing tooling to curing temperatures. The low-expansion alloy system of 36 to 42 weight percent nickel and balance of essentially iron has been commercially used for these tooling applications. These iron-base alloys are, however, inherently soft, difficult to weld in large sections, lack dimensional stability after thermomechanical processing, and are difficult to machine. For example, the knives used to remove graphite epoxy composites from the tooling routinely cut into and mar the tooling's surface. Another problem with these iron-base low expansion alloys is general corrosion that accelerates during the curing of graphite epoxy tooling.

Structural graphite epoxy composites have CTEs that are highly variable with orientation. Typically graphite-epoxy composites have CTEs that range from 1.8 to $9.0\times10^{-6}$ m/m/°C. (1.0 to $5.0\times10^{-6}$ in/in/°F.) depending upon orientation. The mean CTE of this composite is about $5.4\times10^{-6}$ m/m/°C. ($3.0\times10^{-6}$ in/in/°F.). The alloys used for this tooling have a lower CTE than the composite being cured. The low CTE tooling provides a constant and uniform compressive force during heating of the composites from room to curing temperatures. This compressive force reduces porosity, permits tight tolerances (e.g., ±0.0051 cm or ±0.002 in or less), and provides high quality composite surfaces. To achieve these goals, CTE of the alloy must be $4.9\times10^{-6}$ m/m/°C. ($2.7\times10^{-6}$ in/in/°F.) or less.

It is an object of this invention to provide a low CTE alloy having good resistance to marring.

It is a further object of this invention to provide a low CTE alloy having good dimensional stability and strength after thermomechanical processing.

It is a further object of this invention to provide a low CTE alloy having relatively good weldability and corrosion resistance.

It is a further object of this invention to provide an alloy particularly suited for curing graphite-epoxy resins.

SUMMARY OF THE INVENTION

The alloy of the invention provides a low coefficient of thermal expansion alloy having a CTE of about $4.9\times10^{-6}$ m/m/°C. or less at 204° C. and a relatively high strength. The alloy contains about 40.5 to about 48 nickel, about 2 to about 3.7 niobium, about 0.75 to about 2 titanium, about 0 to about 1 aluminum, about 3.7 or less total niobium plus tantalum and a balance of iron and incidental impurities. Alloys of the invention may be aged to a Rockwell C hardness of at least about 30.

DESCRIPTION OF PREFERRED EMBODIMENT

Figure 1:
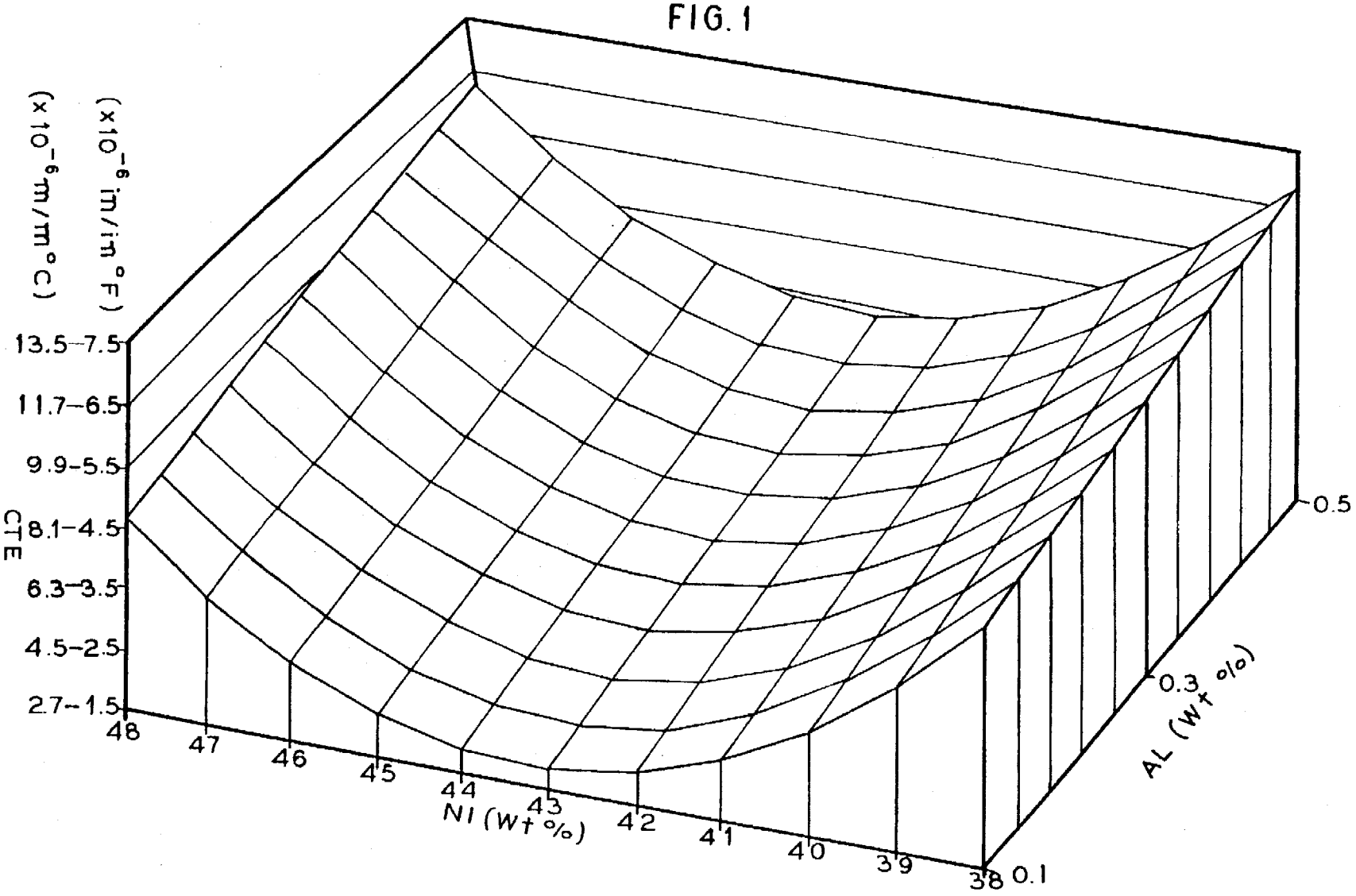
FIG. 1 is a three dimensional plot of coefficient of thermal expansion versus nickel and aluminum content at 400° F. (204° C.)

It has been discovered that niobium and titanium may be used in combination to provide an age hardenable alloy while maintaining a relatively low CTE. The alloys of the invention are readily aged to produce a hardness of at least 30 on the Rockwell "C" (RC) scale. For comparative purposes, NILO® alloy 36 typically only has a hardness of 71 on the Rockwell "B" (RB) scale (NILO is a trademark of the Inco family of companies). The alloys of the invention are uniquely characterized by a relatively low CTE in combination with excellent marring resistance.

The alloys of Table 1 were prepared for testing.

TABLE 1

| HEAT | C | MN | FE | S | SI | NI | CR | AL | TI | MG | CO | MO | NB | TA | NB + TA |
|---|---|---|---|---|---|---|---|---|---|---|---|---|---|---|---|
| 1 | 0.004 | 0.2 | 56.7 | 0.001 | 0.1 | 38.17 | <0.1 | 0.33 | 1.5 | <0.1 | <0.1 | <0.1 | 2.9 | 0.001 | 2.9 |
| 2 | 0.005 | 0.2 | 54.9 | 0.001 | 0.1 | 40.09 | <0.1 | 0.12 | 1.5 | <0.1 | <0.1 | <0.1 | 2.9 | 0.001 | 2.9 |
| 3 | 0.018 | 0.2 | 54.8 | 0.001 | 0.1 | 40.24 | <0.1 | 0.30 | 1.5 | <0.1 | <0.1 | <0.1 | 2.9 | 0.001 | 2.9 |
| 4 | 0.003 | 0.2 | 54.8 | 0.001 | 0.1 | 40.07 | <0.1 | 0.32 | 1.5 | <0.1 | <0.1 | <0.1 | 2.9 | 0.001 | 2.9 |
| 5 | 0.005 | 0.2 | 54.4 | 0.001 | 0.1 | 40.06 | <0.1 | 0.51 | 1.5 | <0.1 | <0.1 | <0.1 | 2.9 | 0.001 | 2.9 |
| 6 | 0.004 | 0.2 | 52.7 | 0.001 | 0.1 | 41.93 | <0.1 | 0.32 | 1.5 | <0.1 | <0.1 | <0.1 | 2.9 | 0.001 | 2.9 |
| 7 | 0.009 | 0.2 | 50.8 | 0.001 | 0.1 | 43.97 | <0.1 | 0.33 | 1.5 | <0.1 | <0.1 | <0.1 | 2.9 | 0.001 | 2.9 |
| 8(1) | 0.011 | 0.31 | Bal. | 0.001 | 0.08 | 43.80 | 0.08 | 0.12 | 1.25 | <0.1 | 0.01 | 0.01 | 3.21 | 0.004 | 3.21 |
| 9 | <.01 | 0.2 | Bal. | 0.001 | 0.11 | 43.76 | 0.01 | 0.16 | 1.45 | <0.I | 0.001 | <0.1 | 3.45 | 0.001 | 3.45 |
| 10 | <.01 | 0.19 | Bal. | 0.001 | 0.12 | 43.77 | 0.03 | 0.11 | 1.48 | <0.1 | 0.001 | <0.1 | 2.93 | 0.001 | 2.93 |
| 11 | 0.026 | 0.31 | 50.9 | <0.001 | 0.08 | 43.70 | 0.04 | 0.18 | 1.45 | <0.1 | 0.28 | <0.1 | 3.03 | 0.003 | 3.03 |
| 12 | 0.02 | 0.31 | 51.1 | <0.001 | 0.08 | 43.77 | 0.03 | 0.08 | 0.95 | <0.1 | 0.20 | <0.1 | 3.38 | <0.01 | 3.38 |
| 13 | 0.005 | 0.19 | 51.2 | 0.002 | 0.12 | 43.33 | 0.08 | 0.14 | 1.42 | <0.1 | <0.1 | <0.1 | 3.46 | 0.001 | 3.46 |

TABLE 1-continued

| HEAT | C | MN | FE | S | SI | NI | CR | AL | TI | MG | CO | MO | NB | TA | NB + TA |
|---|---|---|---|---|---|---|---|---|---|---|---|---|---|---|---|
| A[2] | 0.01 | 0.01 | Bal. | 0.009 | <0.01 | 43.61 | N/A | 0.17 | 1.48 | N/A[3] | N/A | N/A | | | 3.94 |
| B[4] | 0.035 | 0.40 | 63.3 | 0.001 | 0.06 | 36.05 | 0.06 | 0.15 | 0.07 | <0.1 | <0.1 | <0.1 | 0.03 | 0.001 | 0.03 |
| C[4] | 0.021 | 0.40 | 63.0 | 0.002 | 0.04 | 36.16 | 0.01 | 0.20 | 0.08 | <0.1 | <0.1 | <0.1 | <0.01 | 0.001 | <0.01 |
| D[4] | 0.026 | 0.38 | 63.0 | 0.002 | 0.05 | 36.21 | 0.01 | 0.21 | 0.08 | <0.1 | <0.1 | <0.1 | <0.01 | 0.001 | <0.01 |

Note:
N/A = Not Analyzed
[1]Contains 0.007 P and 0.05 Cu
[2]Corresponds to alloy A of U.S. Pat. No. 3,514,284 (For comparative purposes only)
[3]None Added
[4]Comparative alloys B, C & D correspond to commercially available low CTE alloy 36
[5]Only analyzed in combination The data of Table 1 are expressed in weight percent. For purpose of this specification, all alloy compositions are expressed in weight percent.

Table 2 below provides coefficient of thermal expansion and hardness data for alloys that were warm worked and aged at 1200° F. (649° C.) for 8 hours then air cooled.

TABLE 2

| | CTE at 400° F. (204° C.) | | |
|---|---|---|---|
| HEAT | in/in/°F. × $10^{-6}$ | m/m/°C. × $10^{-6}$ | Hardness (RC) |
| 1 | 5.91 | 10.6 | 40 |
| 2 | 3.06 | 5.51 | 39 |
| 3 | 3.62 | 6.52 | 40 |
| 5 | 4.56 | 8.21 | 37 |
| 6 | 2.58 | 4.64 | 39 |
| 7 | 2.52 | 4.53 | 36 |

For comparison purposes, the CTE of graphite-epoxy composites at 360° F. (182° C.) is $3.1\times10^{-6}$ in/in/°F. ($5.6\times10^{-6}$ m/m/°C.).

Figure 2:
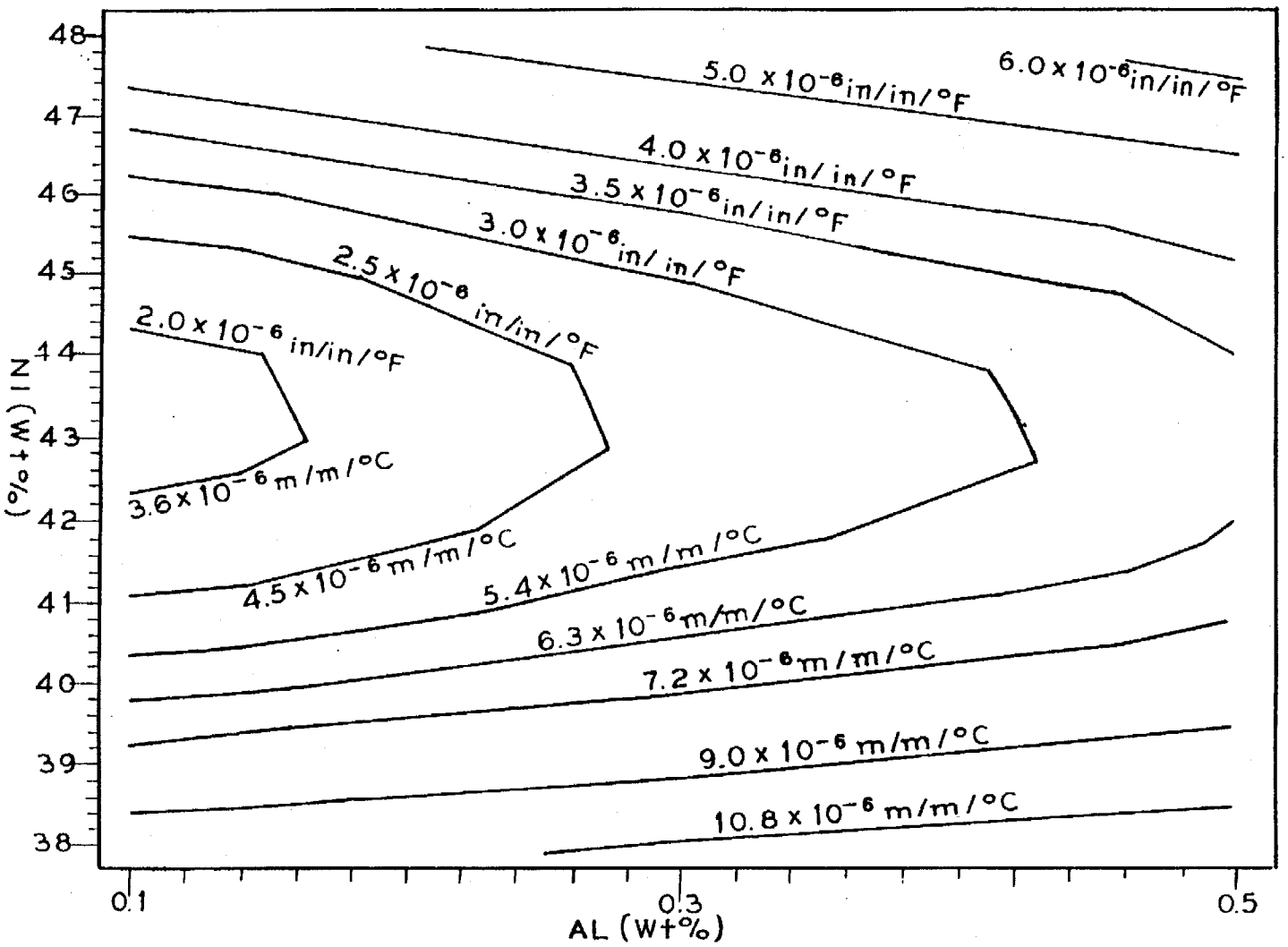
FIG. 2 is a two dimensional graph of coefficient of thermal expansion versus nickel and aluminum content at 400° F. (204° C.)

FIGS. 1 and 2 illustrate that CTE reaches a minimum above about 42.3% nickel. Advantageously, alloys of the invention contain sufficient nickel to provide a relatively low CTE of less than or equal to about $4.9\times10^{-6}$ m/m/°C. ($2.7\times10^{-6}$ in/in/°F.) at 204° C. (400° F.). Most advantageously, the CTE is less than or equal to about ($4.5\times10^{-6}$ m/m/°C. ($2.5\times10^{-6}$ in/in/°F.) at 204° C. (400° F.). At 204° C. (400° F.), expansion may be estimated by the following:

$$\text{CTE (m/m/°C.)}=441.52\times10^{-6}-20.27\times10^{-6}\,(\text{Ni})+0.23\times10^{-6}(\text{Ni}^2)+6.79\times10^{-6}\,(\text{Al})$$

$$\text{CTE (in/in/°F.)}=245.29\times10^{-6}-11.26\times10^{-6}\,(\text{Ni})+0.13\times10^{-6}(\text{Ni}^2)+3.77\times10^{-6}\,(\text{Al})$$

Figure 3:
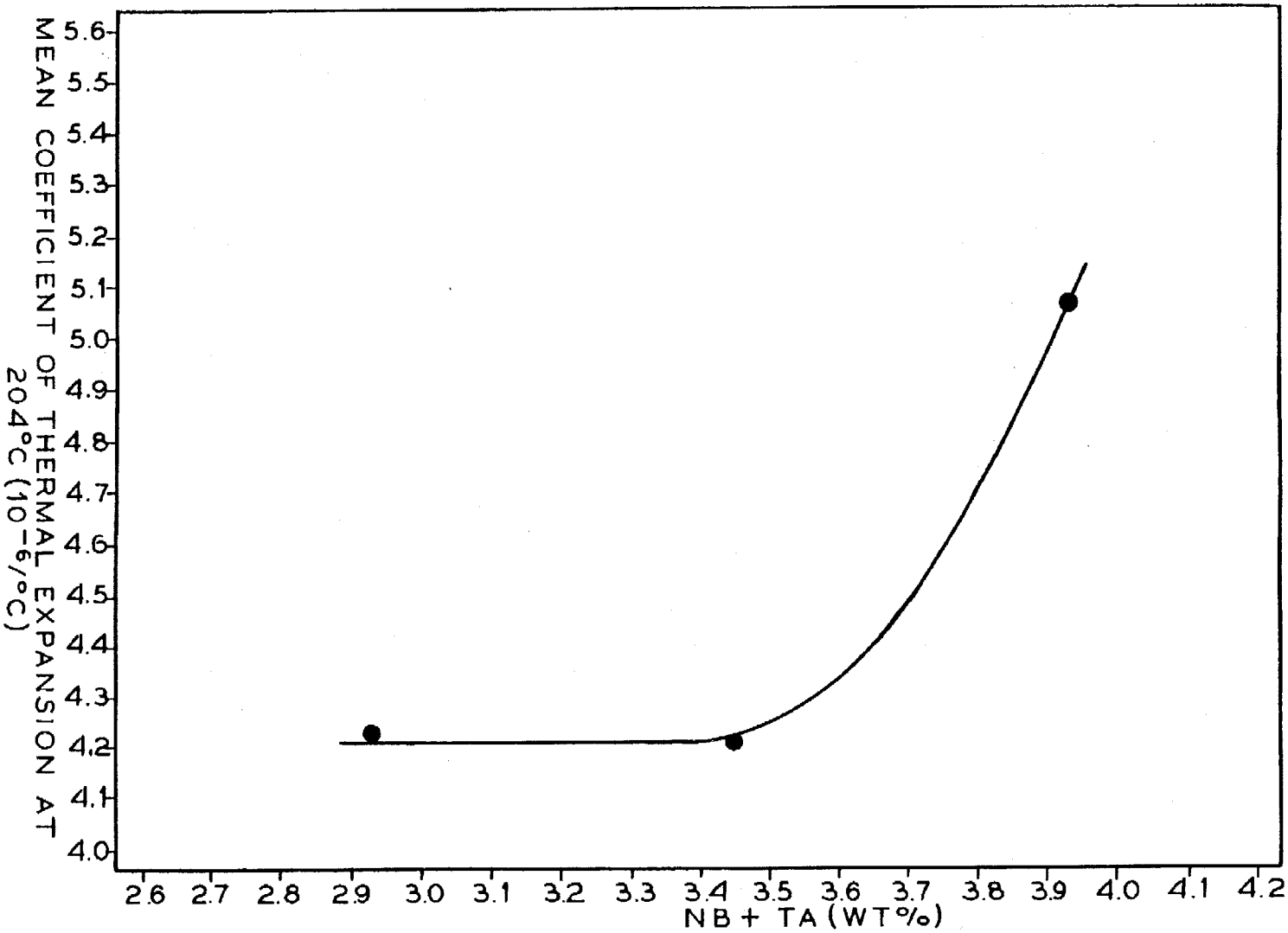
FIG. 3 is a graph of coefficient of thermal expansion versus total niobium plus tantalum content at 204° C. (400° F.).

FIG. 3 illustrates that total niobium and tantalum must be limited to about 3.7 weight percent to maintain a CTE less than $4.9\times10^{-6}$ m/m/°C. At total niobium plus tantalum concentrations above about 3.5 weight percent, the 204° C. (400° F.) CTE of the alloy dramatically increases.

Most advantageously, tantalum is maintained at concentrations below about 0.25 weight percent. Tantalum concentrations above about 0.25 weight percent are believed to be detrimental to weldability and phase segregation. Alloys containing less than 0.25 weight percent tantalum may be readily formed into large sections free of both macro- and micro-segregation. Furthermore, an optional addition of at least about 0.15 weight percent manganese facilitates hot working of the alloy. In addition, boron may optionally be added to the alloy in quantities up to about 0.1 weight percent.

Table 3 below illustrates that CTE increases dramatically with niobium plus tantalum compositions above 3.45 weight percent at temperatures between 142° C. and 315° C.

TABLE 3

Age Hardenable NI—Fe Alloys, wt %

| | Coefficient of Thermal Expansion | | | | | | | | | | |
|---|---|---|---|---|---|---|---|---|---|---|---|
| Heat | 200° F. (× $10^{-6}$/°F.) | 142° C. (× $10^{-6}$/°C.) | 400° F. (× $10^{-6}$/°F.) | 204° C. (× $10^{-6}$/°C.) | 500° F. (× $10^{-6}$/°F.) | 260° C. (× $10^{-6}$/°C.) | 600° F. (× $10^{-6}$ °F.) | 315° C. (× $10^{-6}$/°C.) | 800° F. (× $10^{-6}$ °F.) | 427° C. (× $10^{-6}$/°C.) | Nb + Ta (wt %) |
| 9 | 2.17 | 3.91 | 2.33 | 4.19 | 2.56 | 4.61 | 3.28 | 5.90 | 4.6 | 8.28 | 3.45 |
| 10 | 2.17 | 3.91 | 2.34 | 4.21 | 2.53 | 4.55 | NT | NT | NT | NT | 2.93 |
| A | 2.9 | 5.22 | 2.8 | 5.04 | 3.1 | 5.58 | 3.7 | 6.66 | 4.8 | 8.64 | 3.94 |

Table 4 below provides hardness of the alloys in the Rockwell "B" scale for various annealing conditions.

TABLE 4

| ANNEAL | | HEAT | | | | | |
|---|---|---|---|---|---|---|---|
| (°F.)/(hr) | (°C.)/(hr) | 1 | 2 | 3 | 5 | 6 | 7 |
| 1600/1 | 871/1 | 91 | 88 | 86 | 90 | 88 | 85 |
| 1650/1 | 915/1 | 89 | 86 | 86 | 96 | 84 | 82 |
| 1700/1 | 926/1 | 86 | 85 | 85 | 84 | 84 | 84 |
| 1750/1 | 954/1 | 84 | 82 | 82 | 85 | 82 | 82 |
| 1800/1 | 982/1 | 84 | 83 | 83 | 84 | 83 | 83 |
| 1850/1 | 1010/1 | 82 | 82 | 82 | 82 | 84 | 80 |
| 1900/1 | 1038/1 | 82 | 82 | 82 | 82 | 81 | 80 |
| 1950/1 | 1066/1 | 82 | 81 | 81 | 82 | 80 | 79 |
| AR | AR | 94 | 95 | 95 | 97 | 95 | 96 |

AR = As warm rolled

Table 5 below provides hardness in the Rockwell "C" scale for alloys treated with various isothermal aging heat treatments directly after warm working the alloys.

TABLE 5

| AGE | | HEAT | | | | | |
|---|---|---|---|---|---|---|---|
| (°F.)/(hr) | (°C.)/(hr) | 1 | 2 | 3 | 5 | 6 | 7 |
| 1150/4 | 621/4 | 36 | 34 | 35 | 35 | 35 | 32 |
| 1150/8 | 621/8 | 39 | 38 | 35 | 37 | 36 | 36 |
| 1200/4 | 649/4 | 36 | 38 | 34 | 38 | 37 | 36 |
| 1200/8 | 649/8 | 38 | 41 | 38 | 41 | 40 | 38 |
| 1250/4 | 677/4 | 34 | 39 | 37 | 40 | 37 | 35 |
| 1250/8 | 677/8 | 38 | 37 | 37 | 39 | 35 | 37 |
| 1300/4 | 704/4 | 35 | 34 | 36 | 37 | 35 | 35 |
| 1300/8 | 704/8 | 35 | 35 | 35 | 38 | 35 | 37 |
| 1350/4 | 732/4 | 34 | 31 | 31 | 30 | 33 | 32 |
| 1350/8 | 732/8 | 31 | 26 | 29 | 33 | 29 | 30 |
| 1400/4 | 760/4 | 28 | 25 | 29 | 31 | 31 | 28 |
| 1450/4 | 788/4 | 23 | 21 | 24 | 25 | 24 | 25 |
| 1500/4 | 815/4 | 19 | 18 | 17 | 18 | 17 | 18 |

Table 6 below provides hardness data for annealed and aged alloys of the invention. The alloy of Table 6 were all annealed at 1700° F. (927° C.) prior to aging.

TABLE 6

| | AGING TEMPERATURE/TIME | | | | | | | |
|---|---|---|---|---|---|---|---|---|
| HEAT | 1150/8 (°F.)/(hr) | 621/8 (°C.)/(hr) | 1200/8 (°F.)/(hr) | 649/8 (°C.)/(hr) | 1250/4 (°F.)/(hr) | 677/4 (°C.)/(hr) | 1250/8 (°F.)/(hr) | 677/8 (°C.)/(hr) |
| 1 | 31 | | 35 | | 32 | | 35 | |
| 2 | 29 | | 35 | | 32 | | 37 | |
| 3 | 29 | | 34 | | 33 | | 35 | |
| 5 | 34 | | 33 | | 35 | | 36 | |
| 6 | 30 | | 36 | | 34 | | 36 | |
| 7 | 28 | | 32 | | 32 | | 33 | |

Tables 4–6 illustrate that the alloys of the invention may be readily age hardened to hardness levels at least as high as about 30 on the Rockwell C scale. Most advantageously, alloys are aged to a hardness of at least about 35 on the Rockwell C scale. Advantageously, the alloys are aged at a temperature between 1000° and 1400° F. (538° and 760° C.). Most advantageously, alloys are aged at a temperature between about 1100° and 1300° F. (593° to 704° C.) for optimum age hardening. It has been discovered that thermomechanical processing followed by an aging heat treatment further optimizes hardness of the alloy.

Table 7 below compares oxidation resistance of alloys of the invention to alloy 36 Ni—Fe after exposure to air at 371° C. for 560 hours.

TABLE 7

| HEAT | CHANGE IN WEIGHT GAIN, MILLIGRAMS/SQUARE CENTIMETER |
|---|---|
| 8 | 0.082 |
| 9 | 0.136 |
| 11 | 0.133 |
| 12 | 0.133 |
| 13 | 0.150 |
| B(Alloy 36) | 0.248 |
| C(Alloy 36) | 0.220 |

Alloys 8 to 13 of Table 7 were annealed then aged as follows:

Anneal—871° C. for one hour, air cooled to room temperature.

Age—677° C. for four hours, furnace cooled at a rate of 55° C. per hour to 621° C., 621° C. for four hours and air cooled to room temperature.

Alloys B, C and D of Table 7 were all annealed as follows:

Anneal—871° C. for one hour and air cooled to room temperature—these alloys are not age hardenable.

The data of Table 7 illustrate that alloy 36 oxidizes nearly twice as rapidly as alloys of the invention at a typical curing temperature for graphite-epoxy composites. Although these alloys lack the oxidation resistance of chromium-containing alloys, the increased oxidation resistance of the invention significantly reduces tooling maintenance. For example, facing plates require less grinding, polishing or pickling to maintain a smooth metal surface.

Table 8 below demonstrates the dimensional stability of alloys of the invention in comparison to 36 Ni—Fe alloys.

TABLE 8

| HEAT | CREEP STRENGTH, MPa |
|---|---|
| 11 | >690 |
| 12 | >690 |
| D(Alloy 36) | 55 |

Heat D was annealed prior to testing. Heats 11 and 12 were annealed and aged as above. The age hardened alloys of the invention provide at least a ten-fold increase in creep resistance. This increase in creep resistance provides excellent dimensional stability that effectively resists deformation during curing. The alloys dimensional stability allows significant reductions of the size and mount of materials necessary to produce durable tooling.

The alloy of the invention is described by alloys having "about" the composition of Table 9 below.

TABLE 9

| | BROAD | INTERMEDIATE | NARROW | NOMINAL |
|---|---|---|---|---|
| Ni | 40.5–48 | 41–46 | 42.3–45 | 43.5 |
| Nb | 2–3.7 | 2.5–3.6 | 3–3.5 | 3.3 |
| Ti | 0.75–2 | 0.9–1.9 | 1–1.8 | 1.4 |
| Al | 0–1 | 0.05–0.8 | 0.05–0.6 | 0.2 |
| C | | 0–0.1 | 0–0.05 | 0.01 |

TABLE 9-continued

| | BROAD | INTERMEDIATE | NARROW | NOMINAL |
|---|---|---|---|---|
| Mn | | 0–1 | 0–0.5 | 0.3 |
| Si | | 0–1 | 0–0.5 | — |
| Cu | | 0–1 | 0–0.5 | — |
| Cr | | 0–1 | 0–0.5 | — |
| Co | | 0–5 | 0–2 | — |
| B | | 0–0.01 | 0–0.005 | — |
| W,V | | 0–2 | 0–1 | — |
| Ta | | | 0–0.25 | |
| Mg, Ca, Ce (Total) | | 0–0.1 | 0–0.05 | — |
| Y, Rare Earths (Total) | | 0–0.5 | 0–0.1 | — |
| S | | 0–0.1 | 0–0.05 | — |
| P | | 0–0.1 | 0–0.05 | — |
| N | | 0–0.1 | 0–0.05 | — |
| Fe | Balance + Incidental Impurities | Balance + Incidental Impurities | Balance + Incidental Impurities | Balance + Incidental Impurities |
| Total Nb + Ta | ≦3.7 | ≦3.6 | ≦3.5 | 3.3 |

The alloy of the invention provides alloys having a coefficient of thermal expansion of $2.7\times10^{-6}$ in/in/°F. ($5.5\times10^{-6}$ m/m/°C.) or less with a minimum hardness of RC30. With a hardness above RC30, composite tooling alloys provide excellent resistance to scratching and marring. In addition, age hardening increases the yield strength of the alloy and machinability of the alloy. The alloy has tested to be excellent with the drop weight and bend tests. The alloy may be readily welded with NILO® filler metals 36 and 42. Finally, the alloys of the invention provide improved oxidation resistance and dimensional stability over conventional iron-nickel low coefficient of thermal expansion alloys.

The alloys of the invention provides an especially useful material for tooling that are used to fabricate graphite-epoxy composites or other low CTE composites under compression. In addition, the alloys of the invention are expected to be useful for high strength electronic strips, age hardenable lead frames and mask alloys for tubes.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

We claim:

1. A high strength low coefficient of thermal expansion alloy having a CTE of about $4.9\times10^{4}$ m/m/°C. or less at 204° C., consisting essentially of, by weight percent, about 42.3 to about 48 nickel, about 2 to about 3.7 niobium, about 0.75 to about 2 titanium, about 0 to about 2 cobalt, about 0 to about 1 aluminum, about 3.7 or less total niobium plus tantalum, and balance iron and incidental impurities.

2. The alloy of claim 1 comprising about 42.3 to about 46 nickel, about 2.5 to about 3.6 niobium, about 0.9 to about 1.9 titanium and about 0.05 to about 0.8 aluminum.

3. The alloy of claim 1 comprising about 0 to about 0.1 carbon, about 0 to about 1 manganese, about 0 to about 1 silicon, about 0 to about 1 copper, about 0 to about 1 chromium, about 0 to about 0.01 boron, about 0 to about 2 tungsten, about 0 to about 2 vanadium, about 0 to about 0.1 total magnesium, calcium and cerium, about 0 to about 0.5 total yttrium and rare earths, about 0 to about 0.1 sulfur, about 0 to about 0.1 phosphorous and about 0 to about 0.1 nitrogen.

4. The alloy of claim 1 having a hardness of at least about 30 on the Rockwell C scale.

5. A high strength low coefficient of thermal expansion alloy having a CTE of about $4.9\times10^{-6}$ m/m/°C. or less at 204° C., consisting essentially of, by weight percent, about 42.3 to about 46 nickel, about 2.5 to about 3.6 niobium, about 0.9 to about 1.9 titanium, about 0.05 to about 0.8 aluminum, about 0 to about 0.1 carbon, about 0 to about 1 manganese, about 0 to about 1 silicon, about 0 to about 1 copper, about 0 to about 2 cobalt, about 0 to about 0.01 boron, about 0 to about 2 tungsten, about 0 to about 2 vanadium, about 0 to about 0.5 total yttrium and rare earths, about 0 to about 0.1 sulfur, about 0 to about 0.1 phosphorous, about 0 to about 0.1 nitrogen, about 3.6 or less total niobium plus tantalum and balance iron and incidental impurities.

6. The alloy of claim 5 comprising about 42.3 to about 45 nickel.

7. The alloy of claim 5 comprising about 3 to about 3.5 niobium, about 1 to about 1.8 titanium and about 0.05 to about 0.6 aluminum.

8. The alloy of claim 5 comprising about 0 to about 0.05 carbon, about 0 to about 0.5 manganese, about 0 to about 0.5 silicon, about 0 to about 0.5 copper, about 0 to about 0.5 chromium, about 0 to about 0.005 boron, about 0 to about 1 tungsten, about 0 to about 1 vanadium, about 0 to about 0.05 total magnesium, calcium and cerium, about 0 to about 0.1 total yttrium and rare earths, about 0 to about 0.05 sulfur, about 0 to about 0.05 phosphorous, less than about 0.25 tantalum and about 0 to about 0.05 nitrogen.

9. The alloy of claim 5 having and a hardness of at least about 30 on the Rockwell C scale.

10. A high strength low coefficient of thermal expansion alloy having a CTE of about $4.9\times10^{-6}$ m/m/°C. or less at 204° C., consisting essentially of, by weight percent, about 42.3 to about 45 nickel, about 3 to about 3.5 niobium, about 1 to about 1.8 titanium, about 0.05 to about 0.6 aluminum, about 0 to about 0.05 carbon, about 0 to about 0.5 manganese, about 0 to about 0.5 silicon, about 0 to about 0.5 copper, about 0 to about 2 cobalt, about 0 to about 0.005 boron, about 0 to about 1 tungsten, about 0 to about 1 vanadium, about 0 to about 0.1 total yttrium and rare canes, about 0 to about 0.05 sulfur, about 0 to about 0.05 phosphorous, about 0 to about 0.05 nitrogen, about 3.5 or less total niobium plus tantalum, about 0 to about 0.25 tantalum and balance iron and incidental impurities.

11. The alloy of claim 10 having a hardness of at least about 35 on the Rockwell C scale.

* * * * *

UNITED STATES PATENT AND TRADEMARK OFFICE

CERTIFICATE OF CORRECTION

PATENT NO. : 5,688,471

DATED : NOVEMBER 18, 1997

INVENTOR(S) : SMITH et al.

It is certified that error appears in the above-identified patent and that said Letters Patent is hereby corrected as shown below:

Column 4, line 36 for "NI" read --Ni--.

Column 6, line 53 for "alloys" read --alloys'--.

Column 7, line 37 for "provides" read --provide--.

Column 7, line 38 for "are" read --is--.

Column 7, line 51 for "$4.9 \times 10^{4}$" read --$4.9 \times 10^{-6}$--.

Column 8, line 51 for "canes" read --earths--.

Signed and Sealed this

Third Day of February, 1998

*Attest:*

BRUCE LEHMAN

*Attesting Officer*

*Commissioner of Patents and Trademarks*